US012520944B2

(12) United States Patent
Boatright

(10) Patent No.: US 12,520,944 B2
(45) Date of Patent: Jan. 13, 2026

(54) TRAVELING SUPPORT DEVICE

(71) Applicant: Mark Boatright, Sterling, VA (US)

(72) Inventor: Mark Boatright, Sterling, VA (US)

( * ) Notice: Subject to any disclaimer, the term of this patent is extended or adjusted under 35 U.S.C. 154(b) by 230 days.

(21) Appl. No.: 18/199,931

(22) Filed: May 20, 2023

(65) Prior Publication Data

US 2024/0188718 A1 Jun. 13, 2024

Related U.S. Application Data

(60) Provisional application No. 63/430,779, filed on Dec. 7, 2022.

(51) Int. Cl.
*A47C 7/42* (2006.01)
*A47G 9/10* (2006.01)

(52) U.S. Cl.
CPC ..... *A47C 7/42* (2013.01); *A47G 9/1045* (2013.01)

(58) Field of Classification Search
CPC ..... A47C 7/383; A47C 7/425; A47C 7/021; A47C 7/622
USPC ..... 297/230–100
See application file for complete search history.

(56) References Cited

U.S. PATENT DOCUMENTS 4,394,783 A * 7/1983 Simmons ..... A47C 7/425 441/127
6,106,123 A * 8/2000 McDonald ..... A61F 9/00 359/872
7,461,421 B1 * 12/2008 Faircloth ..... A47G 9/1045 5/639
11,844,452 B1 * 12/2023 Wu ..... A47G 9/1045
2009/0283557 A1 * 11/2009 Maginness ..... A47C 16/00 224/153
2012/0222219 A1 * 9/2012 Pusca ..... A47C 16/00 5/655.3
2020/0178709 A1 * 6/2020 Brown ..... G09F 23/00

* cited by examiner

*Primary Examiner* — David R Dunn
*Assistant Examiner* — Jessica Kathryn Thompson
(74) *Attorney, Agent, or Firm* — The Iwashko Law Firm, PLLC; Lev Ivan Gabriel Iwashko

(57) ABSTRACT

A traveling support device, including a main body having an elongate shape and to be disposed on a surface, a cushion removably connected to at least a portion of the main body to receive a portion of a body of a user thereon, such that the cushion is disposed a distance furthest away from the surface, and a storage compartment disposed within at least a portion of the main body, the storage compartment including a storage body to store at least one item therein, and a door movably disposed on at least a portion of the storage body to move from closed in a first position to at least partially opened in a second position, and move from opened in the second position to closed in the first position.

6 Claims, 3 Drawing Sheets

TRAVELING SUPPORT DEVICE

CROSS-REFERENCE TO RELATED APPLICATIONS

This application claims priority under 35 USC § 120 from U.S. Provisional Application No. 63/430,779, entitled "Traveling Support Device," which was filed on Dec. 7, 2022, in the United States Patent and Trademark Office, the disclosure of which is incorporated herein in its entirety by reference.

BACKGROUND

1. Field

The present general inventive concept relates generally to traveling, and particularly, to a traveling support device.

2. Description of the Related Art

Many people traveling on a transportation vehicle, such as an airplane and/or a train, will remain in a seat for long periods of time. Some people will attempt to sleep due to fatigue and/or lack of activity. However, during extended travel on the transportation vehicle, it can be difficult to sleep and/or rest.

Currently, there are some accessories available for people that travel on the airplane, such as a neck pillow. Unfortunately, the neck pillow does not offer proper head and/or body support, as a person using it is often under continuous movement from the transportation vehicle that causes the person to awaken frequently. Also, the neck pillow does not offer any type of storage capabilities.

Therefore, there is a need for a traveling support device to adequately support the head and/or the body of a user during travel, as well as, provide ability to store items.

SUMMARY

The present general inventive concept provides a traveling support device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a traveling support device, including a main body having an elongate shape and to be disposed on a surface, a cushion removably connected to at least a portion of the main body to receive a portion of a body of a user thereon, such that the cushion is disposed a distance furthest away from the surface, and a storage compartment disposed within at least a portion of the main body, the storage compartment including a storage body to store at least one item therein, and a door movably disposed on at least a portion of the storage body to move from closed in a first position to at least partially opened in a second position, and move from opened in the second position to closed in the first position.

The main body may be planar on a first side and have an arcuate shape on a second side opposite with respect to the first side.

The traveling support device may further include a cushion receiving recess disposed on at least a portion of a first end of the main body to receive the cushion therein.

The cushion receiving recess may be pressure fit to the cushion.

The traveling support device may further include a shoulder strap removably connected to at least a portion of the main body to suspend the main body while being worn by the user.

The traveling support device may further include a plurality of hand straps disposed on at least a portion of the main body to receive each hand of the user therein.

The traveling support device may further include a belt hook disposed on at least a portion of the main body to connect to a belt of the user.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

List of Components

Traveling Support Device 100
Main Body 110
Cushion 120
Cushion Receiving Recess 130
Storage Compartment 140
Storage Body 141
Door 142
Knob 143
Shoulder Strap 150
Strap Connectors 160
Strap Compartment 170
Hand Straps 180
Belt Hook 190

Figure 1:
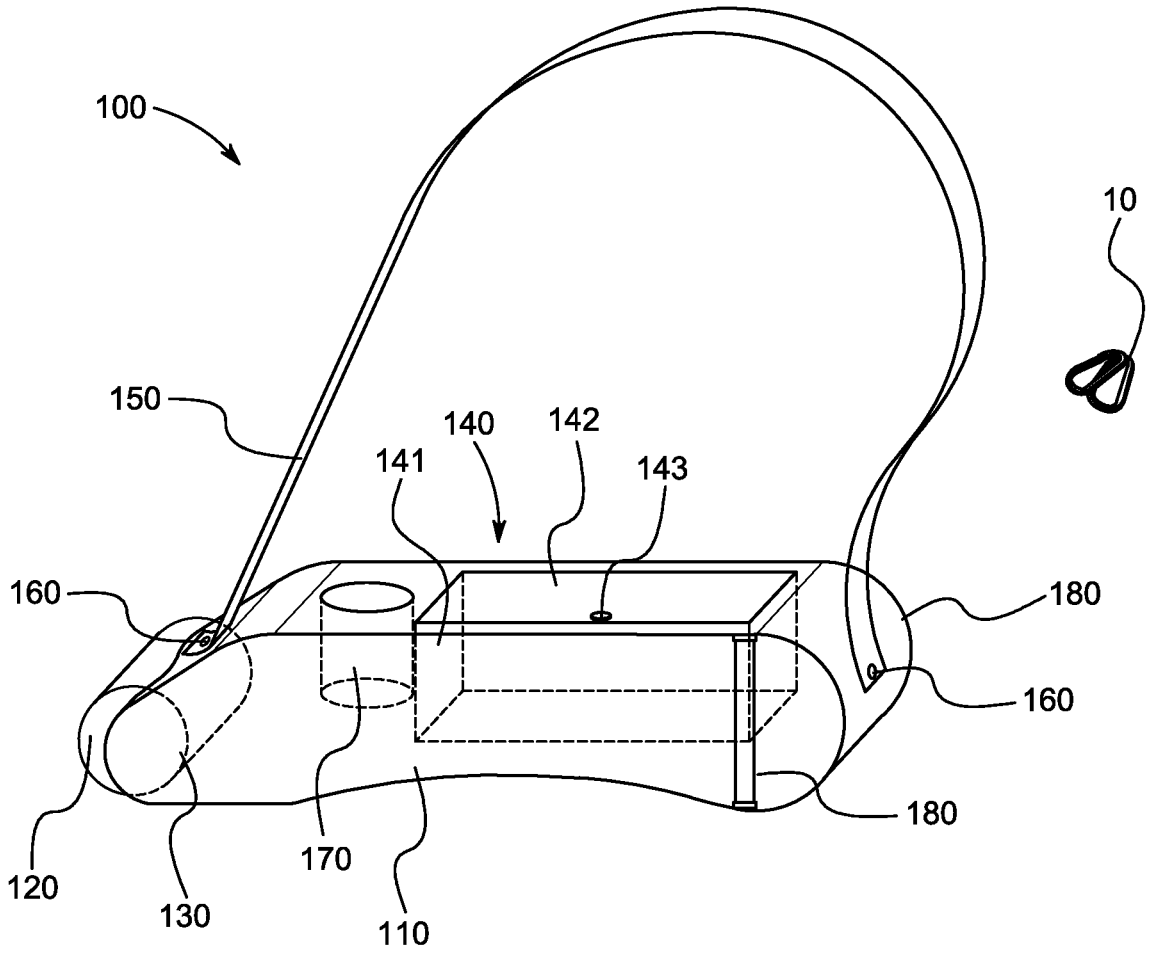
FIG. 1 illustrates a side perspective view of a traveling support device, according to an exemplary embodiment of the present general inventive concept.

FIG. 1 illustrates a side perspective view of a traveling support device 100, according to an exemplary embodiment of the present general inventive concept.

Figure 2:
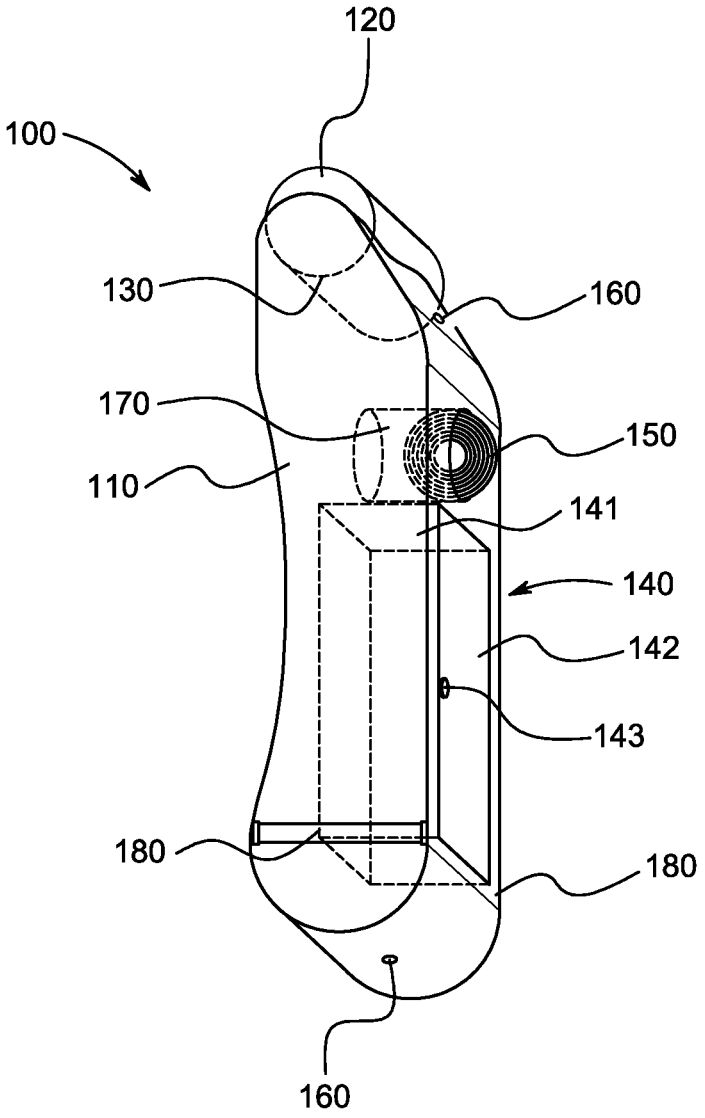
FIG. 2 illustrates a side perspective view of the traveling support device, according to an exemplary embodiment of the present general inventive concept.

FIG. 2 illustrates a side perspective view of the traveling support device 100, according to an exemplary embodiment of the present general inventive concept.

Figure 3:
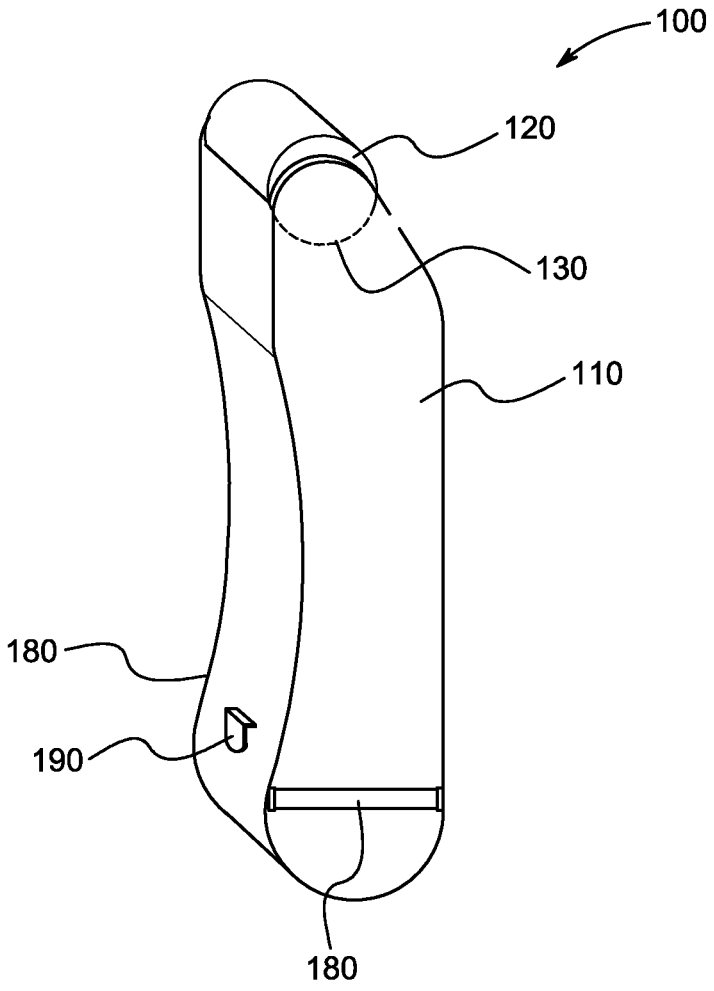
FIG. 3 illustrates a side perspective view of the traveling support device, according to an exemplary embodiment of the present general inventive concept.

FIG. 3 illustrates a side perspective view of the traveling support device 100, according to an exemplary embodiment of the present general inventive concept.

The traveling support device 100 may be constructed from at least one of metal, plastic, cloth, wood, and rubber, etc., but is not limited thereto.

The traveling support device 100 may include a main body 110, a cushion 120, a cushion receiving recess 130, a storage compartment 140, a shoulder strap 150, a plurality of strap connectors 160, a strap compartment 170, a plurality of hand straps 180, and a belt hook 190, but is not limited thereto.

The main body 110 may have an elongate shape. Moreover, the main body 110 may be planar on a first side and have an arcuate (i.e., curved, concave) shape on a second side opposite with respect to the first side. The arcuate shape of the main body 110 may facilitate holding and/or resting by a user due to the curved shape. In other words, the arcuate shape of the main body 110 may arch a back of the user during holding (e.g., hugging) with a chest and/or a torso of the user being pressed against the arcuate shape.

The cushion 120 may include foam, feathers, cloth, down, memory foam, shredded memory foam, latex, bamboo, and gel, but is not limited thereto.

The cushion 120 may be removably connected (i.e., without tools, screws, bolts, nails, adhesive) to at least a portion of the main body 110. The cushion 120 may receive and/or support a portion of a body of the user therein, such as a head and/or a neck of the user. The cushion 120 may at least partially deform (e.g., bend, flex, expand) in response to an application of force (e.g., pushing, pulling, receiving the body of the user) thereto. As such, the cushion 120 may provide comfort to the user during use.

The cushion receiving recess 130 may be disposed on at least a portion of a first end of the main body 110. The cushion receiving recess 130 may receive the cushion 120 therein. The cushion receiving recess 130 may be specially constructed to fit the cushion 120 without use of at least one external tool (e.g., a fastener, a screwdriver, a hammer, etc.). More specifically, the cushion receiving recess 130 may pressure fit the cushion 120, such that the cushion receiving recess 130 may prevent extraction of the cushion 120 in absence of an application of force (e.g., pushing, pulling) by the user. In other words, turning the main body 110 upside down and/or shaking the main body 110 with the cushion 120 inserted, would not remove the cushion 120.

The storage compartment 140 may include a storage body 141, a door 142, and a knob 143, but is not limited thereto.

The storage body 141 may be disposed within at least a portion of the main body 110. The storage body 141 may store at least one first item therein. For example, the storage body 141 may store clothing, toiletries, and/or food. Additionally, the storage body 141 may include a plurality of pockets disposed on at least a portion of at least one wall within the storage body 141. In other words, each of the plurality of pockets may store the at least one first item therein. As such, the plurality of pockets may improve organization within the storage body 141.

Furthermore, the storage body 141 may have at least one carabiner clip 10 disposed therein. The storage body 141 may use the at least one carabiner clip 10 to store (i.e., hold) a key, a ring, a hanger, and/or any other items as desired by the user.

The door 142 may be movably (i.e., pivotally, hingedly) disposed on at least a portion of the storage body 141. The door 142 may move (i.e., pivot, rotate) from closed in a first position to at least partially opened in a second position. Conversely, the door 142 may move from opened in the second position to closed in the first position. As such, the door 142 may allow access within the storage body 141 in the opened position and prevent access within the storage body 141 in the closed position.

The knob 143 may be movably (i.e., rotatably) disposed on at least a portion of the door 142. The knob 143 may move (i.e., rotate) clockwise from locked in a first position to unlocked in a second position. Conversely, the knob 143 may move (i.e., rotate) counterclockwise from unlocked in the second position to locked in the first position. As such, the knob 143 may unlock and/or lock the door 142. Also, the knob 143 may facilitate gripping thereof.

The shoulder strap 150 may be removably connected to at least a portion of the main body 110. The shoulder strap 150 may allow the main body 110 to be suspended therefrom while connected to the main body 110. For example, the shoulder strap 150 may be worn around a portion of the body of the user, such as a should of the user to support the main body 110 therefrom.

Each of the plurality of strap connectors 160 may include a hook, a button, a snap, a clip, a clamp, a clasp, an adhesive (e.g., tape, glue), a magnet, and/or any combination thereof, but is not limited thereto.

The plurality of strap connectors 160 may be disposed on at least a portion the first end of the main body 110 and a second end of the main body 110 opposite with respect to the first end. The plurality of strap connectors 160 may receive and/or removably connect to a first end of the shoulder strap 150 and a second end of the shoulder strap 150. Accordingly, the plurality of strap connectors 160 may secure the shoulder strap 150 to the main body 110.

The strap compartment 170 may be disposed on at least a portion of the main body 110. The strap compartment 170 may be recessed with respect to an outer surface of the main body 110. The strap compartment 170 may store at least one second item therein. For example, the strap compartment 170 may store the shoulder strap 150 and/or a beverage container (e.g., a cup, a can, a bottle) therein.

The plurality of hand straps 180 may be disposed on at least a portion of a third side of the main body 110 and/or a fourth side of the main body 110 opposite with respect to the third side. The plurality of hand straps 180 may be elastic. In other words, the plurality of hand straps 180 may at least partially deform (e.g., bend, stretch, expand) in response to an application of force (e.g., pushing, pulling) thereto. For example, each of the plurality of hand straps 180 may receive a hand of the user therein, such that each of the plurality of hand straps 180 may expand and/or stretch to accommodate each hand therein. Also, the plurality of hand straps 180 may allow the user to relax each hand during travel.

The belt hook 190 may be disposed on at least a portion of the second side of the main body 110. The belt hook 190 may fasten and/or connect to a portion of the body of the user. For example, the belt hook 190 may connect to a belt of the user to stabilize the main body 110 against the body of the user during use.

During use, the main body 110 may be oriented in a vertical position, such as on a table and/or a tray of a transportation vehicle (e.g., a plane, a bus, a train). The cushion 120 may receive the head and/or the neck of the user, while the user holds (i.e., hugs) the main body 110. As such, the user may sleep on the cushion 120 without having to worry about falling during sleep since the weight of the user is stabilized on the cushion 120 and/or the main body 110. Also, the user may sleep without worrying of being awakened from drifting during sleep, and experiencing neck soreness from poor positioning.

Therefore, the traveling support device 100 may support the head and/or the torso of the user during travel. Also, the traveling support device 100 may store items, such as carry-on items.

The present general inventive concept may include a traveling support device 100, including a main body 110 having an elongate shape and to be disposed on a surface, a cushion 120 removably connected to at least a portion of the main body 110 to receive a portion of a body of a user thereon, such that the cushion 120 is disposed a distance furthest away from the surface, and a storage compartment 140 disposed within at least a portion of the main body 110, the storage compartment 140 including a storage body 141 to store at least one item therein, and a door 142 movably disposed on at least a portion of the storage body 141 to move from closed in a first position to at least partially opened in a second position, and move from opened in the second position to closed in the first position.

The main body 110 may be planar on a first side and have an arcuate shape on a second side opposite with respect to the first side.

The traveling support device 100 may further include a cushion receiving recess 130 disposed on at least a portion of a first end of the main body 110 to receive the cushion 120 therein.

The cushion receiving recess 130 may be pressure fit to the cushion 120.

The traveling support device 100 may further include a shoulder strap 150 removably connected to at least a portion of the main body 110 to suspend the main body 110 while being worn by the user.

The traveling support device 100 may further include a plurality of hand straps 180 disposed on at least a portion of the main body 110 to receive each hand of the user therein.

The traveling support device 100 may further include a belt hook 190 disposed on at least a portion of the main body 110 to connect to a belt of the user.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A traveling support device, comprising:

a main body having an elongate shape and to be disposed on a surface;

a cushion removably connected to at least a portion of the main body to receive a portion of a body of a user thereon, such that the cushion is disposed a distance furthest away from the surface; and a storage compartment disposed within at least a portion of the main body, the storage compartment comprising:

a storage body to store at least one item therein, a door movably disposed on at least a portion of the storage body to hingedly move from closed in a first position to at least partially opened in a second position, and hingedly move from opened in the second position to closed in the first position, and knob rotatably disposed on at least a portion of the door to rotate from locked in a first position to lock the door, to unlocked in a second position to unlock the door, wherein the main body is planar on a first side and have an arcuate shape on a second side opposite with respect to the first side, and wherein the cushion is positioned on a third side of the body between the first and second sides.

2. The traveling support device of claim 1, further comprising:

a cushion receiving recess disposed on at least a portion of a first end of the main body to receive the cushion therein.

3. The traveling support device of claim 2, wherein the cushion receiving recess is pressure fit to the cushion.

4. The traveling support device of claim 1, further comprising:

a shoulder strap removably connected to at least a portion of the main body to suspend the main body while being worn by the user.

5. The traveling support device of claim 1, further comprising:

a plurality of hand straps disposed on at least a portion of the main body to receive each hand of the user therein.

6. The traveling support device of claim 1, further comprising:

a belt hook disposed on at least a portion of the main body to connect to a belt of the user.

* * * * *